United States Patent [19]

Butka

[11] 4,003,664

[45] Jan. 18, 1977

[54] MECHANICAL PENCIL WITH LEAD FEED RESPONSIVE TO WRITING PRESSURE

[76] Inventor: Kemal Butka, 372 Central Park West, New York, N.Y. 10025

[22] Filed: Dec. 18, 1975

[21] Appl. No.: 641,916

[52] U.S. Cl. ..... 401/67

[51] Int. Cl.[2] ..... B43K 21/16

[58] Field of Search ..... 401/53, 65–67, 401/92–94, 80

[56] References Cited

UNITED STATES PATENTS

| | | | |
|---|---|---|---|
| 1,745,658 | 2/1930 | Becker | 401/67 X |
| 2,026,815 | 1/1936 | Barker | 401/53 |
| 2,865,330 | 12/1958 | Swank | 401/53 |
| 3,424,535 | 1/1969 | Schischkow | 401/53 |
| 3,864,046 | 2/1975 | Butka | 401/67 |

*Primary Examiner*—Lawrence Charles
*Attorney, Agent, or Firm*—Michael J. Striker

[57] ABSTRACT

A mechanical pencil, especially for thin leads, in which a tubular guide projects from and is guided for movement in axial direction in one end of a tubular casing. Lead is automatically advanced through the casing as a function of pressure exerted on the tubular guide during writing or drawing by successively compressing and expanding a tubular, resilient element having a conically-shaped end. During writing or drawing, the resilient element is compressed and its conically shaped end is wedged in tight engagement into a cooperating conically shaped end of an abutment member so as to clamp lead passing through the casing, thereby preventing the lead from moving inwardly during writing. When pressure is terminated, the resilient element is restored to its expanded condition, thereby freeing the lead to advance.

14 Claims, 6 Drawing Figures

MECHANICAL PENCIL WITH LEAD FEED RESPONSIVE TO WRITING PRESSURE

BACKGROUND OF THE INVENTION

Mechanical pencils are known in which the lead is protected against breaking by means of a tubular lead guide which projects beyond one end of the tubular casing of the pencil and which surrounds the lead substantially up to the writing point thereof. Such pencils are especially adapted for use with thin and/or soft leads, for instance with leads which have a diameter of 0.5 or 0.3 mm, and which are eventually also rather soft. Such pencils with thin leads make it possible to draw or write with fine or heavy lines, which is possible with mechanical pencils using relatively large diameter leads and with wooden pencils, only if the leads are carefully sharpened. Such repeated careful sharpening of the lead is, however, avoided with thin-lead mechanical pencils.

A disadvantage of mechanical pencils of the aforementioned kind is that the position of the lead relative to the lead guide has to be repeatedly and exactly adjusted since the lead will not write any longer when its end projecting beyond the lead guide is used up, and since if the lead extends too far beyond the lead guide it will easily break, and that therefore the adjustment of the position of the lead relative to the lead guide must be made much more carefully than with mechanical pencils of the usual heavy lead type.

An attempt has already been made to avoid the aforementioned disadvantage by a construction in which the lead guide is not fixedly connected to the casing, but is mounted in the lower end of the casing for movement in longitudinal direction, and wherein the lead guide engages the lead with a predetermined frictional force which is chosen in such a manner that the lead will be moved relative to the lead guide by a small pressure, for instance by engagement of the lead guide with the writing surface or by an advancing movement of the lead.

During writing or drawing, the lead will be pushed back by the pressure exerted thereon so that practically only the end face of the lead, that is the acting writing face thereof will project beyond the tubular lead guide. As the lead is used up, the lead guide will come into contact with the writing surface and will thereby gradually be pushed back into the pencil casing, so that only the end face of the lead will remain in contact with the writing surface, whereas the portion thereof projecting beyond the pencil casing will be surrounded and thereby protected by the non-bendable tubular lead guide.

Thus the necessity of repeatedly adjusting the lead is avoided, and the position of the lead has to be adjusted only when its whole length projecting beyond the lower end of the casing is used up.

It is also known in the art of mechanical pencils to adjust the position of the lead automatically as a function of pressure exerted on the tubular lead guide. However, such pencils are constructed of a large number of parts, each of which perform a separate function, thereby making the entire assembly complex and expensive. Thus, the prior art provides one member for clamping the lead during writing, another member for transmitting axial pressure from the tubular lead guide member to the clamping member, and yet another member for restoring the tubular lead guide member back to its original position when the axial pressure has been terminated. This multi-element construction makes the cost and construction of such pencils very prohibitive.

SUMMARY OF THE INVENTION

Accordingly, it is the general object of the present invention to overcome the disadvantages of the prior art.

Another object of the present invention is to further improve mechanical pencils, especially for thin leads.

Still another object of the present invention is to reduce the number of parts in the assembly of mechanical pencils so as to reduce the cost of manufacture.

Yet another object of the present invention is to reduce the number of parts of such mechanical pencils so as to simplify the construction thereof.

In keeping with these objects and others which will become apparent hereinafter, one feature of the invention resides, briefly stated, in a combination in a mechanical pencil, especially for thin leads, which comprises a tubular guide having a tip projecting coaxially beyond a lower end of an elongated tubular casing, the tubular guide having a passage through which lead may pass to said tip. The tubular guide is mounted and guided for movement in axial direction in the lower end of the casing. Abutting means are spaced from the lower end of the casing and has a central passage through which lead may pass. Also, the abutting means has a contact surface at an end thereof which faces the lower end of the tubular casing and which bounds a conical interior section. Means for automatically feeding the lead in direction outwardly of the tip as a function of the exertion of pressure on the tip during writing or drawing includes a tubular, resilient element having upper and lower wall portions bounding a central channel which is coaxial with the central passage of the abutting means. The upper wall portions of the resilent element are movable between a normal position in which the central channel allows the lead from the central passage to pass therethrough and a clamping position in which the upper wall portions clamp the lead in the central channel. The lower wall portions of the resilient element frictionally engage the lead in the central channel. Furthermore, the resilient element has an end adjacent the tubular guide and has another conically shaped end which is adjacent the contact surface of the abutting means and is so configurated so as to be wedged in tight engagement within the conical interior section upon slight inward movement of the tubular guide when pressure is exerted on the tip thereof for thereby moving the upper wall portions towards the clamping position so as to tightly engage the lead in the central passage. The conically shaped end of the resilient element is normally loosely received within the conical interior section upon slight outward movement of the tubular guide when the pressure on the tip has been terminated and thereby permits the upper wall portions of the resilient element to return to their normal position and also permits the lower wall portions thereof to frictionally engage the lead and advance the same automatically along with the outward movement of the tubular guide towards the tip.

The feature of the single tubular resilient element thus greatly reduces the number of parts needed to automatically feed the lead through the pencil because a separate clamping member, a separate transmitting member and a separate restoring member are not required. The tubular resilient element performs all of these functions due to the conically shaped configuration of its end region which is adjacent the abutting means. Consequently, the cost and construction of such pencils is greatly reduced, thereby simplifying the assembly.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 4:
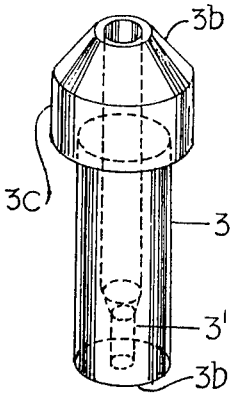
FIG. 4 is an isometric view of the tubular resilient element of the pencil.
Figure 5:
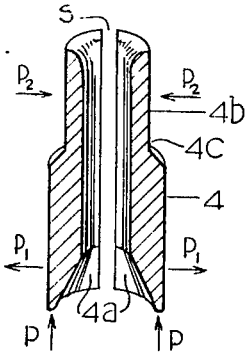
FIG. 5 is an axial secton through the additional clamping means of FIG. 2 which diagrammatically illustrates the operation thereof.
Figure 6:
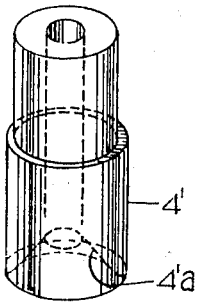
FIG. 6 is an isometric view of the abutting means employed in the embodiment of FIG. 3.
Figure 2:
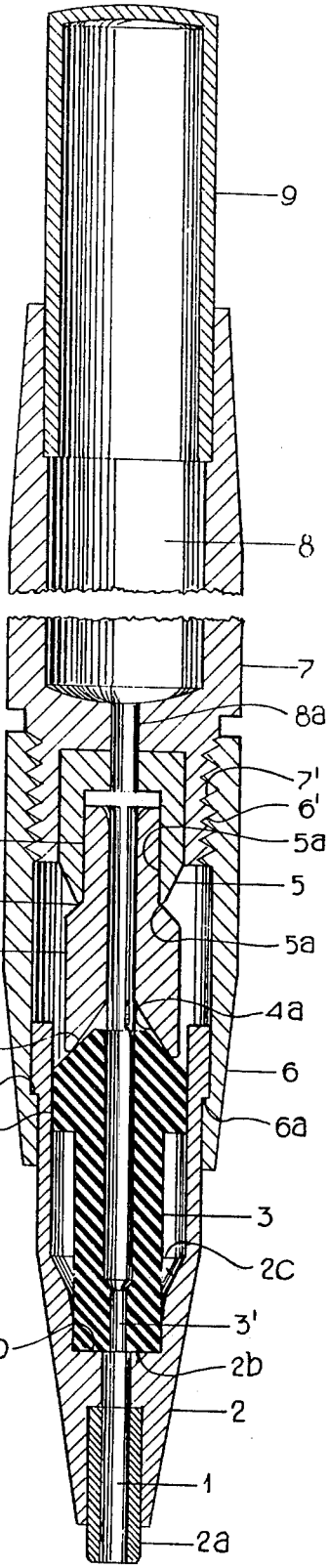
FIG. 2 is a partial, enlarged, axial cross-section through the pencil shown in FIG. 1.
Figure 3:
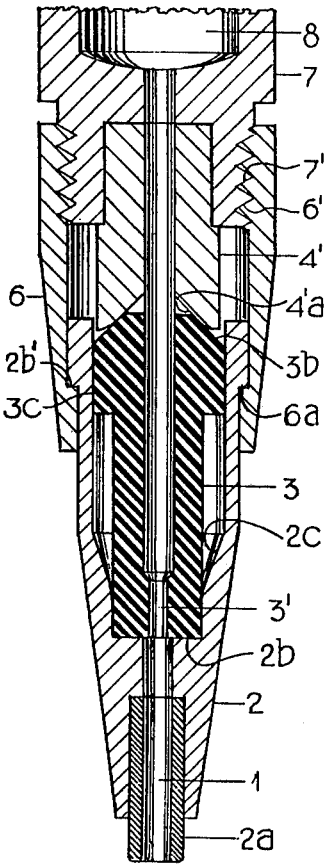
FIG. 3 is analogous to FIG. 2, but illustrates another embodiment according to the present invention.
Figure 1:
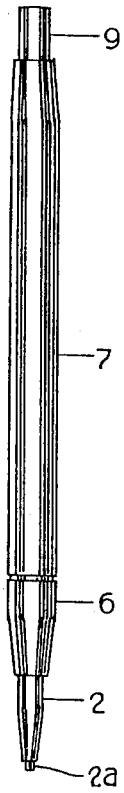
FIG. 1 is a side view of the mechanical pencil according to the present invention.

Referring now to the drawing and, more specifically, to FIGS. 1 – 6 thereof, it will be seen that the mechanical pencil, according to the present invention, comprises an elongated tubular casing comprising a substantially cylindrically upper tubular casing part 7 to the lower end of which a slightly conical tubular part 6 is connected, preferably releasably, by means of a threaded connection 6', 7', as clearly shown in the embodiments of FIGS. 2, 3.

A storage space 8 for storing a plurality of leads is provided in the upper portion of the substantially cylindrical casing part 7, as clearly shown in FIG. 2, and the bottom wall of the storage space 8 is curved towards the center thereof so that leads in the storage space 8 will automatically slip into the bore 8*a* when a lead located therein is used up to permit movement of a new lead into this bore 8*a*. The upper end of storage space 8 may be closed by an eraser 9.

The portion 6 of the casing of the pencil is formed at the lower end thereof with a stepped bore forming an annular shoulder face 6*a*. The tubular lead guide 2 which projects with a portion thereof beyond the lower end of the portion 6 comprises a tip 2*a* and an outer substantially rigid sleeve, the outer surface of which is likewise stepped so that the guide 2 is slidably guided into the stepped bore of the portion 6 and is provided with a corresponding stop shoulder face 2*a'* that is adapted to engage the shoulder face 6*a* so as to limit the outward movement of the guide 2 relative to the portion 6. The tip or bottom end of the guide 2 is slightly inwardly curved, as clearly shown in FIGS. 2 and 3, and surround a lead 1 passing therethrough with a very small clearance.

Means for automatically feeding the lead 1 in direction outwardly of the tip 2*a* as a function of the exertion of axial pressure on the tip 2*a* during writing or drawing includes a tubular, resilient element 3. The element 3 may be constituted of any slightly resilient material, such as rubber or synthetic plastic material. Element 3 has a lower end 3*b* mounted flush against wall 2*b* of an interior tapered bore 2*c* provided in the tubular guide 2, and an opposite upper end which is conically shaped with a contact end face 3*b* which converges in direction away from the tip 2*a*.

In addition, element 3 has upper and lower wall portions (see FIG. 4) which bound a central channel through which the lead 1 may pass. The central channel has an upper tubular section whose cross-section is configurated so as to accommodate the lead 1 with more clearance than its lower tubular section 3'.

The upper wall portions of element 3 are movable between a normal position in which the central channel permits the lead 1 to easily pass therethrough and a clamping position in which the upper wall portions clamp the lead in the central channel. As for the lower wall portions which bound the lower tubular section 3', the friction between the outer surface of the lead 1 and the inner circumferential surface of the tubular section 3' must be great enough to assure that the lead is advanced when the guide 2 moves outwardly of the casing during expansion of the element 3, as will be described later herein. On the other hand, the friction between the tubular section 3' and the lead 1 must be small enough to permit easy movement of the guide 2 and the tubular section 3' relative to the lead 1 during application of normal writing or drawing pressure.

Abutting against the contact end face 3*b* of element 3 is another contact surface which also converges in direction axially away from the tip 2*a* but, preferably, at a faster rate as compared to the rate of convergence of end face 3*b*.

Thus, in the embodiment of FIG. 2, the abutting means comprises a stationary tubular member 5 which has its upper end mounted in tight engagement, preferably press-fitted, in an axial bore of the casing. The member 5 has a central passage coaxial with bore 8*a* and, in addition, has an internal bore 5*a* which receives the outer circumferential wall 4*b* of a pair of additional clamping means or semi-cylindrical portions 4. The portions 4 are slightly separated from each other in the radial direction so as to define a slit or space S therebetween (see FIG. 5). The portions 4 are movable between a normal first position in which the lead 1 being fed through bore 8*a* may pass and a second position in which the lead is prevented from passing therethrough when pressure is exerted on the tip 2*a*. The lower end region of the pair of semi-cylindrical portions 4 bound the contact surface 4*a* which defines a generally conical interior section in which the upper conically shaped end of member 3 is normally loosely received.

In the embodiment of FIG. 3, the semi-cylindrical portions 4 have been eliminated to simplify the assembly even further and, in this case, the clamping action is provided solely by the upper wall portions of element 3. Stationary member 4' has one end tightly mounted, preferably pressed-fitted, in an axial bore of the casing; whereas, its opposite end has a conical shape with the contact surface 4'*a* (see FIG. 6).

The operation of the mechanical pencil is as follows:

FIGS. 2 and 3 illustrate the normal position of the various elements of the pencil when not in use.

Either of the cooperating stop faces 2*a'* in FIG. 2 or 2*b'* in FIG. 3 may engage stop face 6*a* when the resilient element 3 is in the full extended or relaxed position, as shown, or else they may be slightly axially spaced from each other. In this position, the conically shaped ends of the abutting members 4 or 4′ will loosely receive the respective ends 3*b* with their respective end faces 4*a* or 4′*a* in mutual contact with the end face 3*b* of the resilient element 3.

Also, the lead 1 which passes through the casing towards the tip 2*a* will not be clamped anywhere along its length. In the embodiment of FIG. 2, the semi-cylindrical portions 4 are in their open normal position in which the space S is far enough apart to permit the lead 1 to pass freely therethrough. Moreover, since the resilient element 3 is not compressed, the upper wall portions thereof will not clamp the lead in the central channel of the element 3. Similarly, for the embodiment of FIG. 3, the upper wall portions of element 3 will not clamp the lead in the central channel thereof.

During writing or drawing, the tip 2of the tubular guide 2 engages the writing or drawing surface and pushes the guide 2 inwardly into the casing. Simultaneously, the resilient element 3 is pushed inwardly with the force P (see FIG. 5). As the element 3 is proressively pushed into the casing, the end face 3*b* will be wedged into the conical section bounded by the surface 4*a* in tighter and tighter engagement.

Particularly for the embodiment of FIG. 2, the lower end of the semi-cylindrical portions 4 surrounding section 4*a* will be urged outwardly of each other in the direction of the arrows P1; whereas, the upper end 4*b* of the semi-cylindrical portions 4 will be urged inwardly of each other in the direction of the arrows P2 about the point 4*c*, thereby clamping the lead in the central passage of space S of the portions 4 and preventing the lead from being fed upwardly away from the tip 2*a*.

At the same time, the upper wall portions of the resilient element 3 will be squeezed inwardly towards each other by the force of end face 4*a* acting on end face 3*b*, thus narrowing the cross-section of the central channel in the element 3 so as to clamp the lead therein.

In addition, this clamping action causes the upper annular end portion 3*c* of element 3 to frictionally slide along the guide 2. Since the lower end portion is also frictionally held in the conical bottom bore 2*c* of the guide 2, the element 3 is compressed and its central wall portions are caused to bulge laterally outwardly into the additional room provided by the conical bore 2*c*, thereby generating a restoring force which will be subsequently used to move the guide 2 outwardly of the casing and return the guide 2 back to its original position. The frictional engagement of the annular end portion 3*c* tends to instantaneously retard the expansion of the element 3 in the upward direction into the interior of the casing. Therefore, the movement of the upper wall portions back to their normal open position occurs slightly before the element 3 returns to its expanded position.

The writing end face of the lead is normally generally flush with the plane of the end face of the tip 2*a*. In use, the tip 2*a* engages the writing or drawing surface and is retracted to the extent that the lead 1 is used up. Subsequently, the tip 2*a* will be briefly disengaged from the writing or drawing surface. Of course, this disengagement will automatically occur at the end of a written word or a drawn line. In this event, the compressed resilient element will restore itself to its extended position, thereby pushing the guide 2 outwardly. Inasmuch as the upper wall portions of element 3 in both embodiments 2 and 3 and the additional clamping portions 4 of the embodiment of FIG. 2 are returned to their non-clamping positions, the lead 1 is free to advance. As noted above, the friction between the lead 1 and the tubular section 3′ of element 3 is great enough to advance the lead when the guide 2 moves outwardly during expansion of the element 3 and during the simultaneous movement of the various clamping means to their open positions.

Thus, the elements of the disclosed mechanical pencil will therefore cooperate with each other to assure automatic feeding of the lead into the tubular lead guide 2 towards the tip 2*a* until all of the leads in the storage space are used up, while the respective lead in use will be protected by the tubular lead guide 2 against breakage.

It will be understood that each of the elements described above, or two or more together, may also find a useful application in other types of mechanical pencils differing from the types described above.

While the invention has been illustrated and described as embodied in a mechanical pencil with lead feed responsive to writing pressure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a mechanical pencil, especially for thin leads, a combination comprising an elongated tubular casing having a lower end; a tubular guide having a tip projecting coaxially beyond said lower end of said casing and having a passage through which lead may pass to said tip; means mounting and guiding said tubular guide for movement in axial direction in said lower end of said casing; abutting means spaced from said lower end of said casing and having a central passage through which lead may pass, said abutting means having a contact surface at an end thereof which faces said lower end of said casing and which bounds a conical interior section; and means for automatically feeding the lead in direction outwardly of said tip as a function of the exertion of pressure on said tip during writing or drawing, said feeding means comprising a tubular, resilient element having upper and lower wall portions bounding a central channel coaxial with said central passage, said upper wall portions being movable between a normal position in which said central channel allows the lead from said central passage to pass therethrough and a clamping position in which said upper wall portions clamp the lead in said central channel, said lower wall portions frictionally engaging the lead in said central channel, said element further having an end adjacent said tubular guide and another conically shaped end which is adjacent said contact surface and which is configurated so as to be wedged in tight engagement within said conical interior section upon slight inward movement of said tubular guide when pressure is exerted on said tip for thereby compressing said element and moving said upper wall portions towards said clamping position so as to tightly engage the lead in said central passage, and said conically shaped end being further configurated so as to be normally loosely received within said conical interior section upon slight outward movement of said tubular guide when said pressure on said tip has been terminated for thereby permitting said compressed element to expand towards an expanded position and said upper wall portions to return to said normal position and said lower wall portions to frictionally engage the lead and advance the same automatically along with the outward movement of said tubular guide towards said tip.

2. A combination as defined in claim 1; and further comprising cooperating stop means on said casing and said tubular guide for limiting axial movement of the latter outwardly relative to said casing.

3. A combination as defined in claim 1, wherein said casing has an axial bore, and wherein said abutting means has another end mounted in tight engagement in said axial bore.

4. A combination as defined in claim 1, wherein both said conical interior section of said abutting means and said conically shaped end of said element converge in direction axially away from said tip.

5. A combination as defined in claim 4, wherein said conical interior section of said abutting means converges at a first rate, and wherein said conically shaped end of said element converges at a second rate which is slower than said first rate.

6. A combination as defined in claim 1, wherein said abutting means further comprises additional clamping means spaced from said upper wall portions of said element in direction axially away from said tip.

7. A combination as defined in claim 6, wherein said additional clamping means comprises a pair of semi-cylindrical portions slightly separated in radial direction so as to define a space therebetween through which lead may pass, said semi-cylindrical portions being movable between a normal first position in which the lead is allowed to pass through said space and a second position in which the lead is prevented from passing therethrough when pressure is exerted on said tip.

8. The combination as defined in claim 7, wherein said abutting means comprises a stationary member having an internal bore, and wherein an end region of said pair of semi-cylindrical portions constitutes said conical interior section and another end region of said pair of semi-cylindrical portions is received in said internal bore.

9. The combination as defined in claim 1, wherein said conically shaped end of said element also has an upper annular portion in frictional engagement with said tubular guide for facilitating movement of said upper wall portions towards their normal position prior to the expansion of said element towards its expanded position.

10. A combination as defined in claim 1, wherein said element has a generally T-shaped crosse-section.

11. A combination as defined in claim 1, wherein said central channel has a circular cross-section and is comprised of a first section bounded in part by said upper wall portions and a second section bounded by said lower wall portions, said second section having a smaller diameter than said first section.

12. A combination as defined in claim 1, wherein said tubular resilient element is constituted of elastomeric material.

13. A combination as defined in claim 1, wherein said tubular guide has a conical bore; and wherein said one end of said element is received in said conical bore.

14. A combination as defined in claim 13, wherein said element further comprises central wall portions intermediate said upper and lower wall portions which bulge laterally outwardly towards the interior circumferential surface of said conical bore when pressure is exerted on said tip.

* * * * *